US008726520B1

(12) United States Patent
Abraham

(10) Patent No.: US 8,726,520 B1
(45) Date of Patent: May 20, 2014

(54) APPARATUS AND METHOD FOR SHAVING AND SCULPTING

(76) Inventor: Ronald Abraham, Brooklyn, NY (US)

( * ) Notice: Subject to any disclaimer, the term of this patent is extended or adjusted under 35 U.S.C. 154(b) by 336 days.

(21) Appl. No.: 13/152,837

(22) Filed: Jun. 3, 2011

(51) Int. Cl.
*B26B 21/00* (2006.01)

(52) U.S. Cl.
USPC ..... 30/50; 30/32; 30/346.57

(58) Field of Classification Search
USPC ..... 30/50, 346.57, 32–49
See application file for complete search history.

(56) References Cited

U.S. PATENT DOCUMENTS

| | | | | |
|---|---|---|---|---|
| 2,086,426 | A * | 7/1937 | Mackenzie | 30/70 |
| 2,127,010 | A | 8/1938 | Sampson | |
| 4,285,124 | A | 8/1981 | Diakonov | |
| 4,461,078 | A | 7/1984 | Carreker | |
| 4,514,903 | A | 5/1985 | Pope | |
| 4,926,553 | A | 5/1990 | Miskin et al. | |
| 4,961,262 | A | 10/1990 | Lawrence | |
| 5,778,535 | A | 7/1998 | Ledesma | |
| 5,908,036 | A | 6/1999 | Andrews | |
| 6,052,905 | A | 4/2000 | Branchinelli et al. | |
| 6,164,290 | A | 12/2000 | Andrews | |
| 6,418,623 | B1 | 7/2002 | Marcarelli | |
| 6,526,660 | B1 * | 3/2003 | MacNeil | 30/61 |
| 6,581,290 | B1 | 6/2003 | Fishel | |
| D524,481 | S | 7/2006 | Allen, Sr. | |
| D542,468 | S | 5/2007 | Stiles | |
| 8,261,451 | B2 * | 9/2012 | Macove | 30/34.1 |
| 2003/0167639 | A1 | 9/2003 | Sassenberg | |
| 2003/0182802 | A1 * | 10/2003 | Vega et al. | 30/50 |
| 2005/0034314 | A1 * | 2/2005 | Cuisinier | 30/527 |
| 2006/0032060 | A1 * | 2/2006 | Nicolosi et al. | 30/346.53 |

* cited by examiner

*Primary Examiner* — Omar Flores Sanchez

(57) ABSTRACT

A razor for shaving and sculpting an area of hair growth has a spaced plurality of blades mounted on a tapered frame that is supported by a handle. The plurality of blades have progressively shorter cutting edges. The cutting edges have ends lying along a converging pair of sides of a triangular region, whose third side is collinear with the longest one of the cutting edges. The shortest one of the cutting edges is closest to a distal vertex formed by the converging pair of sides. The spacing between the longest and the shortest one of the cutting edges exceeds the distance from the shortest one to the distal vertex. The razor is moved across the area of hair growth with the shortest one of the cutting edges in a leading position, while keeping the cutting edges substantially within a triangular facial section having a remote vertex, in order to remove hair from inside the triangular section. The shaver is stopped when the shortest one of the cutting edges (a) arrives close to the remote vertex without bringing the cutting edges substantially outside the triangular facial section, and (b) is spaced from the remote vertex by a distance that is less than the spacing between the longest one and the shortest one of the cutting edges.

28 Claims, 7 Drawing Sheets

APPARATUS AND METHOD FOR SHAVING AND SCULPTING

BACKGROUND OF THE INVENTION

1. Field of the Invention

The present invention relates to shaving and sculpting and, in particular, to devices and methods for handling areas of hair growth having intricate shapes.

2. Description of Related Art

The trimming and shaping of beards, mustaches, side burns, and other areas of hair growth is important for maintaining an appropriate personal appearance.

Men often wear mustaches that descend downwardly from the corners of the lips to merge at an acute angle with a beard running along the cheekbone. Shaving into the restricted space within this acute angle is difficult. Also a beard can run along the chin, but otherwise leave the region under the lower lip hairless except for a vertical branch that runs upwardly toward the lower lip. Again, shaving the relatively small region on either side of this vertical branch can be difficult Traditional shavers have relatively wide blade or blades designed to shave broad areas indiscriminately. These shavers include the type that can be opened to receive a double-edged shaving blade. More modern types of shavers are disposable and have plastic frames holding a single blade at an appropriate shaving angle. Multiple parallel blades have also been mounted in a single plastic frame to increase the shaving efficiency.

These shavers are intended to remove the most amount of hair with the least number of shaving strokes. These shavers are inadequate to the task of shaving the small regions described above. While one could make a shaver that is less wide, it would still be inadequate for shaving the smaller regions such as the vicinity encompassed by the acute angle formed between a beard and mustache, as noted above.

See also U.S. Pat. Nos. 2,127,010; 4,285,124; 4,461,078; 4,514,903; 4,926,553; 4,961,262; 5,778,535; 5,908,036; 6,052,905; 6,164,290; 6,418,623; 6,581,290; D524,481; and D542,468, as well as US Patent Publication No. 2003/0167639.

SUMMARY OF THE INVENTION

In accordance with the illustrative embodiments demonstrating features and advantages of the present invention, there is provided a razor for shaving and sculpting an area of hair growth on a person. The razor has a spaced plurality of blades mounted on a tapered frame that is supported by a handle. The plurality of blades have progressively shorter cutting edges. The cutting edges have ends lying along a converging pair of sides of a triangular region, whose third side is collinear with the longest one of the cutting edges. The shortest one of the cutting edges is closest to a distal vertex formed by the converging pair of sides. The spacing between the longest and the shortest one of the cutting edges exceeds the distance from the shortest one to the distal vertex.

In accordance with another aspect of the invention, a method is provided for shaving and sculpting an area of hair growth on a person. The method employs a tapered shaver with a spaced plurality of progressively shorter cutting edges. The method includes the step of moving the tapered shaver across the area of hair growth with the shortest one of the cutting edges in a leading position, while keeping the cutting edges substantially within a triangular facial section having a remote vertex, in order to remove hair from inside the triangular section. The method includes the step of interrupting shaving movement of the shaver when the shortest one of the cutting edges (a) arrives close to the remote vertex without bringing the cutting edges substantially outside the triangular facial section, and (b) is spaced from the remote vertex by a distance that is less than the spacing between the longest one and the shortest one of the cutting edges.

By employing apparatus and methods of the foregoing type, one is able to better shave and sculpt around intricate regions of hair growth. In a disclosed embodiment, blades are arranged on a triangular frame in a sequence with progressively shorter blades being positioned closer to a vertex of the triangle. The blades are arranged on the triangular frame so that the shortest blade will be in a leading position. Accordingly, the shaver can be moved into the relatively small region between converging areas of hair growth.

In the disclosed embodiments, blades are held on a frame having the outline of a right triangle or an isosceles triangle.

The disclosed frame has a number of shelves or tiers for holding shaving blades in parallel and at an appropriate shaving angle. More than one blade can be mounted on a shelf by using a spacer.

The tapered frame can be mounted on a handle at a fixed angle. Alternatively, the frame can be pivotally mounted on the handle so that the frame and, its blades easily follow the changing contours of the region being shaved. In one embodiment, the pivoting mechanism is part of the handle. In such an embodiment the frame with shaving blades can be removed before snapping a replacement frame back onto the handle. The frame can be replaced either because its blades are dull or because a frame with a different geometry is required to accommodate a different area of hair growth.

The shaver can be offered as a kit having a common handle together with a variety of frames with different outlines. For example, the collection can include blade holding frames having the following outlines: (a) a relatively wide rectangle; (b) a relatively narrow rectangle or square; (c) a pair of right triangles, one being the mirror image of the other; (d) an isoceles triangle.

A disclosed embodiment packages the kit in a holder having recesses conforming to the outline of the handle and each of the blade holding frames of the collection. In some cases the holder will have recesses on both sides in order to accommodate a larger number of blade holding frames.

BRIEF DESCRIPTION OF THE DRAWINGS

The above brief description as well as other objects, features and advantages of the present invention will be more fully appreciated by reference to the following detailed description of illustrative embodiments in accordance with the present invention when taken in conjunction with the accompanying drawings, wherein.

DETAILED DESCRIPTION

Figure 1:
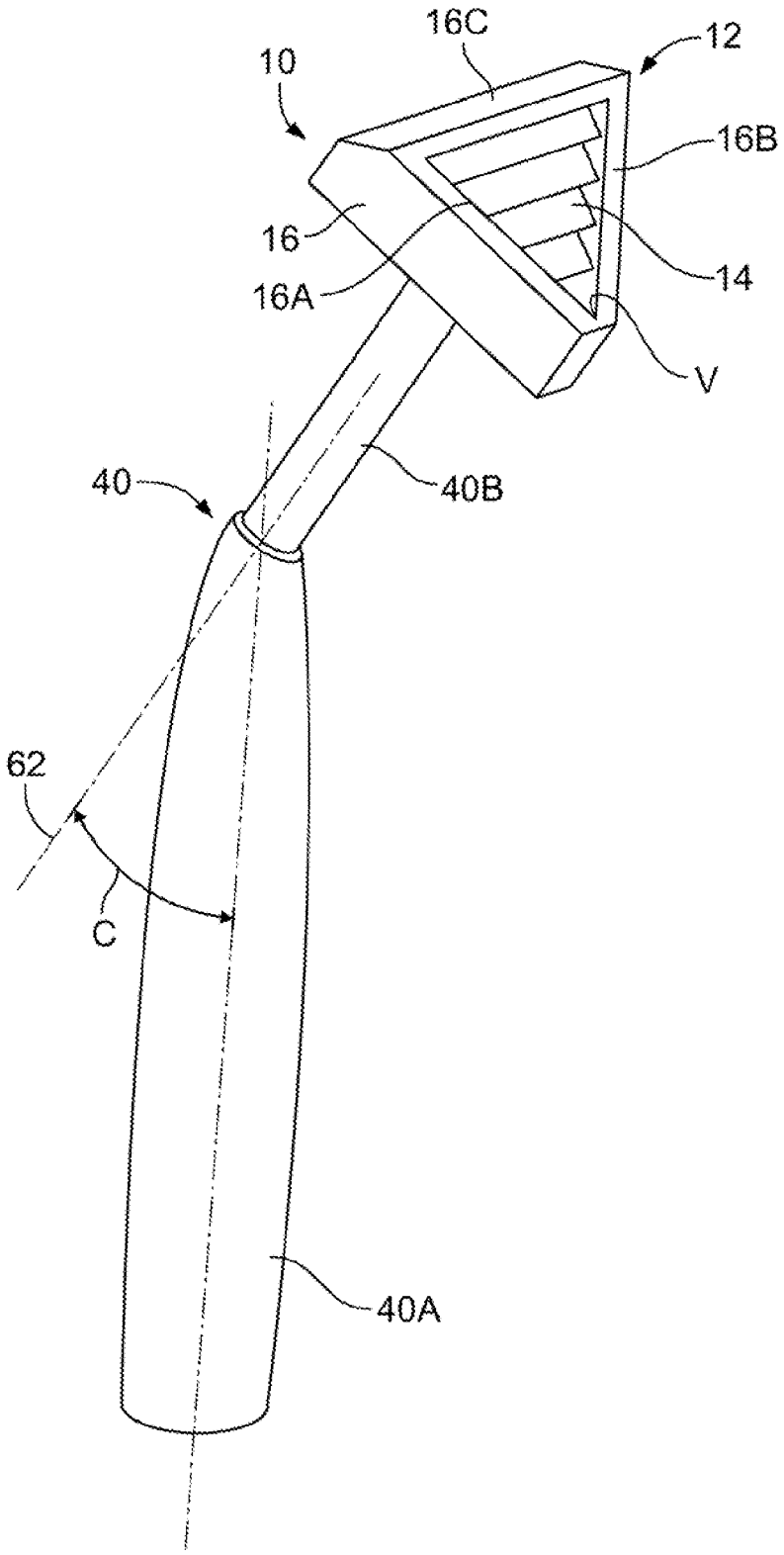
FIG. 1 is a perspective view of a razor shown as a tapered shaver in accordance with principles of the present invention.

Referring to FIGS. 1-4, 5A-5D, and 6A, razor 10 is shown in the form of a tapered triangular shaver having a tapered frame 12 supporting a plurality of blades 14A, 14B, 14C and 14D (collectively referred to as blades 14). Blades 14A, 14B, 14C and 14D have cutting edges 14A1, 14B1, 14C1 and 14D1, respectively, and mounting holes 14A1, 14B2, 14C2, and 14D2, respectively.

Blade 14A has a trapezoidal outline with a cutting edge 14A1 that is parallel to the opposite side, which opposite side intersects with its adjacent sides at an acute angle on one end, and at a right angle at the other end. Blades 14B, 14C and 14D have a similar outline but with different proportions. The distance between each of the cutting edges 14A1, 14B1, 14C1 and 14D1 and their respective opposite side is referred to as the transverse dimension.

Blades 14 are shown mounted on a base 18 (part of tapered frame 12), which has leading shelf 24 and trailing shelf 26 (also referred to as tiers 24 and 26). Tier 24 has a pair of upright cylindrical stubs 20 and tier 26 has a has a trio of uprights cylindrical stubs 22. In this embodiment stubs 20 and 22 are integral with base 18, which is injection molded plastic, although other types of materials can be used instead.

Figure 2:
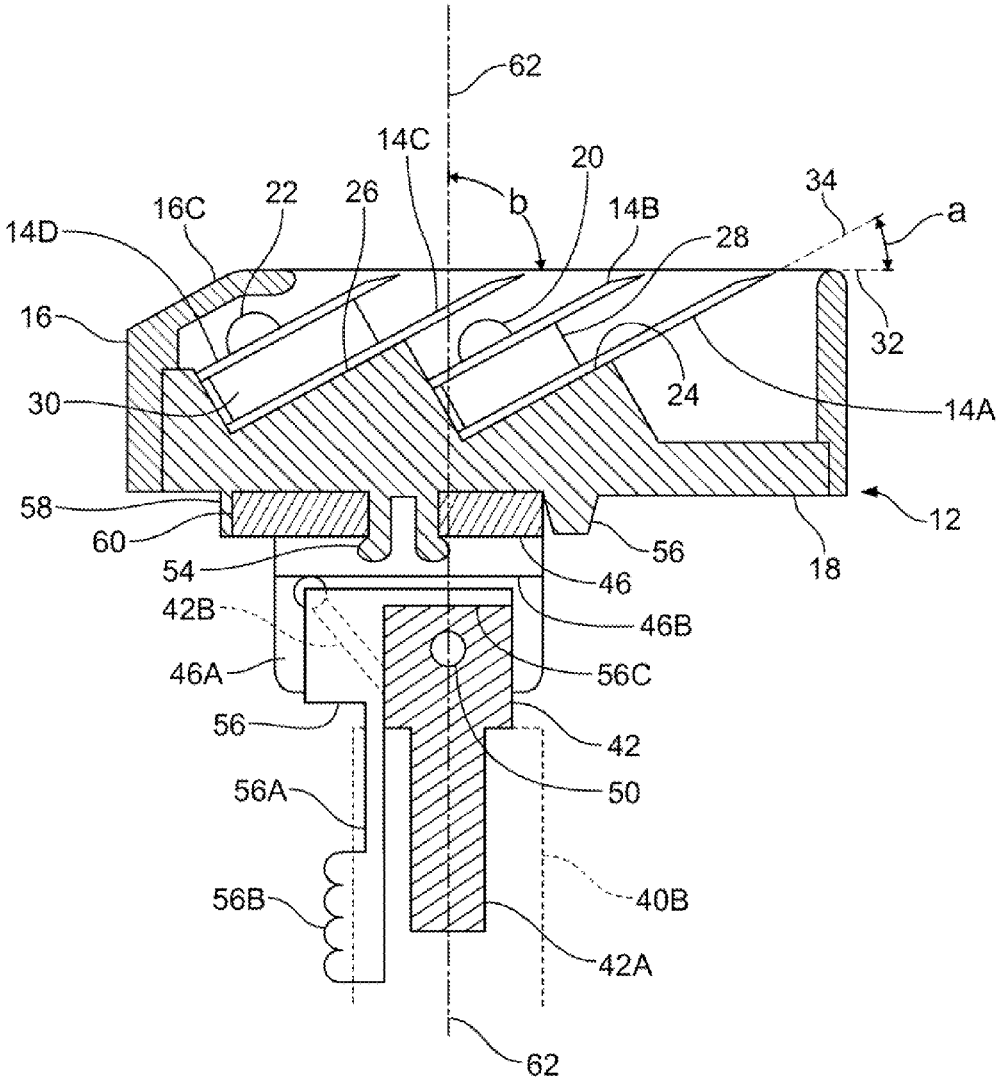
FIG. 2 is an elevational cross-sectional view of the upper portion of the razor of FIG. 1.
Figure 3:
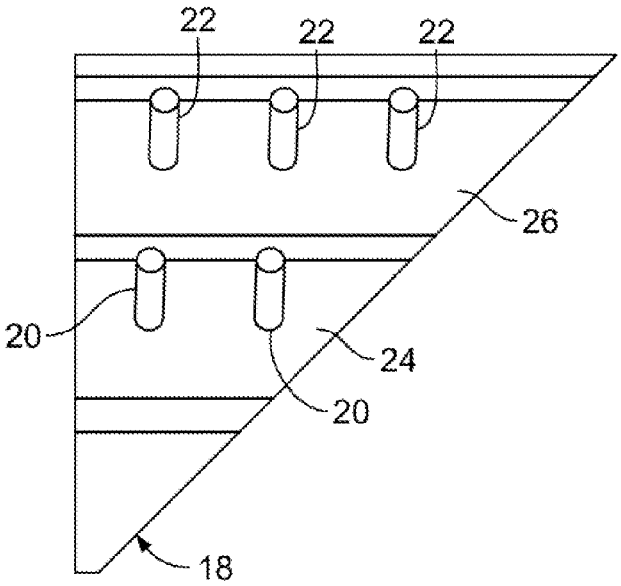
FIG. 3 is a plan view of part of the frame of the razor of FIG. 1.
Figure 4:
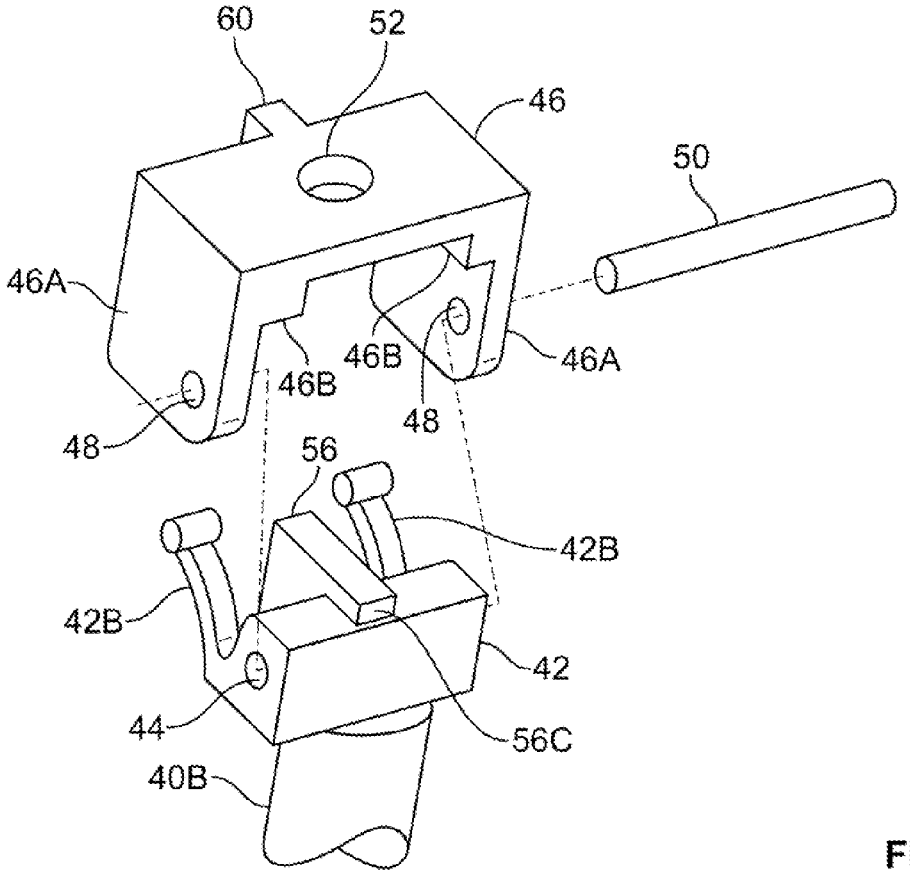
FIG. 4 is an exploded, perspective view of the pivoting mechanism employed in the handle of the razor of FIG. 1.
Figure 5A:
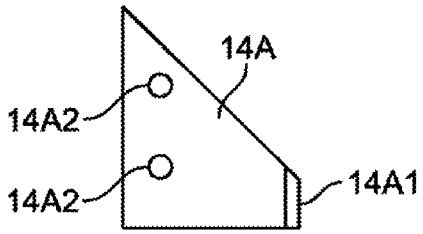
FIG. 5A through 5D are plan views of the blades of FIG. 2.
Figure 5B:
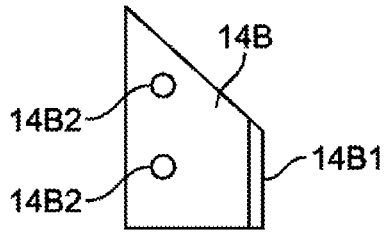
Figure 5C:
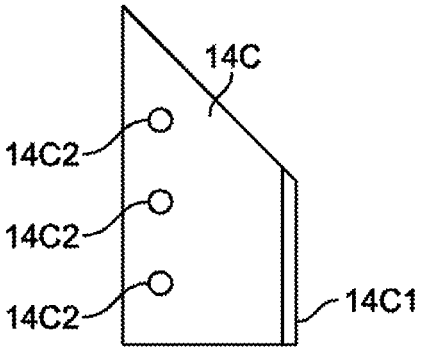
Figure 5D:
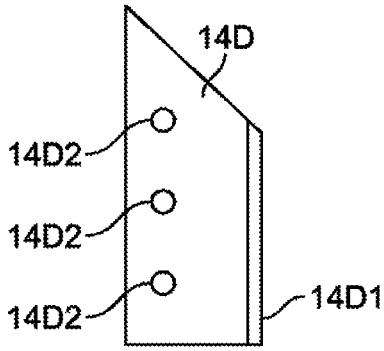

Mounting holes 14A2 in blade 14A register with stubs 20 so that blade 14A can be placed over stubs 20 to rest directly on tier 24, as shown in FIG. 2. Spacer 28 is a rectangular slab with a pair of holes (not shown) that register with stubs 22 so spacer 28 can rest atop blade 14A.

Blade 14B is placed atop spacer 24 with its holes 14B2 registered on stubs 20. Stubs 20 are then heated and pressed down as shown in FIG. 2 to hold in place spacer 28 and blades 14A and 14B.

In a similar fashion, blade 14C, spacer 30 and blade 14D are stacked on tier 26 with stubs 22 inserted through the respective holes in each. As before, stubs 22 are heated and pressed as shown in FIG. 2 to hold in place spacer 30 and blades 14C and 14D.

Annular cover 16 is positioned on base 18 and has on top a right triangular opening for exposing the full length of cutting edges 14A1, 14B1, 14C1 and 14D1. The rim of this triangular opening lies in plane 32. This triangular opening is bordered by a converging pair of walls 16A and 16B. The back wall of cover 16 has an overhang 16C whose edge is parallel to blades 14.

Blades 14 are parallel and lie just below plane 32. The tips of the cutting edges 14A1, 14B1, 14C1 and 14D1 are coplanar and parallel to plane 32. The plane of each of the blades 14 (e.g. plane 34) intersect plane 32 at an angle a, which angle is in the range of 10° to 30°.

The right and left ends of the cutting edges 14A1, 14B1, 14C1 and 14D1 lie along a converging pair of sides of a triangular region (these sides lie on the inside face of walls 16A and 16B). These converging sides intersect at a distal vertex V of the triangular region, whose third side is collinear with cutting edge 14D1. Of course it will be understood that cutting edge 14A1 does not reach vertex V, but is part of an arrangement made with blades 14 that can be extrapolated to define a triangle.

In this embodiment, the inside surface of wall 16A is perpendicular to blades 14, and lies at an angle of 45° relative to the inside surface of wall 16B. While the ends of the blades 14 thus lie along the sides of the right triangle and converge toward a distal vertex of 45' in other embodiments different types of triangles may be employed with sides converging to a vertex that is greater or less than 45°.

Cutting edges 14A1, 14B1, 14C1 and 14D1 are progressively shorter to accommodate the substantially triangular outline of tapered frame 12. The geometry of blades 14 enable them to reach into relatively narrow areas of hair growth. In this embodiment, cutting edge 14D1 is the longest one, and is over four times the length of the longest one, cutting edge 14A1. While this ratio criteria provides good results, satisfactory results can been achieved when cutting edge 14D1 is more than twice the length of cutting edge 14A1. Also, good results are achieved when the distance between cutting edges 14D1 and 14A1 is at least three times the distance between cutting edge 14A1 and vertex V. In fact, satisfactory results are achieved when the distance between cutting edges 14D1 and 14A1 exceeds the distance between cutting edge 14A1 and vertex V.

Base 18 of frame 12 is releasably attached to handle 40. Handle 40 has a relatively thick grip 40A that supports stem 40B at an angle c, which is 30° in this embodiment, but may be in the range of 0 to 45°. Stem 40B has an axial bore for receiving post 42A of block 42, which block has a transverse bore 44, sized to fit pin 50. Clevis 46 has on its opposite arms 46A a pair of aligned holes 48, also sized to fit pin 50. Arms 46A can straddle block 42 with holes 44 and 48 aligned so that pin 50 can be inserted through the holes in order to pivotally connect clevis 46 and block 42. The inside corners of clevis 46 have rectangular shelves 46B that can swing into engagement with the top of block 42 to limit the extent of rotation of the clevis.

Block 42 is molded with springy arms 42B on the right and left that both extend upwardly at about 45° from a lower edge of block 42 and terminate in a cylindrical bearing. Arms 42B engage shelves 46B and bias clevis 46 to rotate in a clockwise direction (as shown in FIG. 2).

The top of clevis 46 has a hole 52 for receiving prong 54 located on the underside of base 18 to form a snap fit joint. Prong 54 is a split cylinder having an enlarged beaded rim. If pushed into hole 52, prong 52 compresses until its beaded rim passes through hole 52 and then snaps into place as shown in FIG. 2. Clevis 46 is guided into position on one side by wall 56 located on the underside of base 18. On the other side, clevis 46 is guided into position by split wall 58 (see FIG. 7 for the layout of walls 56 and 58). The split in wall 58 provides in opening for key 60, a short stub projecting from the top of clevis 46 and ensuring that the frame 12 can be oriented in only one way.

With prong 54 snapped into clevis 46 as shown in FIG. 2, arms 42B bear against shelves 46B and tend to rotate frame 18 clockwise (in this view). Frame 12 is shown in FIG. 2 oriented with plane 32 at a right angle to the axis 62 of stem 40B, that is, angle b is 90°. However, frame 18 and clevis 46 are free to rotate ±45° and thus the angle of elevation of plane 32 is variable. If no torque is applied, arms 42B will rotate clevis 46 and frame 18 clockwise 45° from the illustrated position to a neutral position (i.e., a depressed angle of elevation). It will be appreciated that the neutral angle and the angular freedom of rotation can be altered depending on the requirements of the shaving application or the preferences of the user.

Slider 56 has a lower arm 56A that is captured in a tunnel (not shown) inside stem 40B. The end of arm 56A is formed into a knurled ridge 56B that extends out through a slot (not shown) in stem 40B to act as a thumb slide. Slider 56 has an upper arm 56C shown in FIG. 4 resting atop block 42. Thumb slide 56B can be pressed upwardly to push arm 56C against prong 54 to dislodge it from hole 52 and release base 18.

Figure 6A:
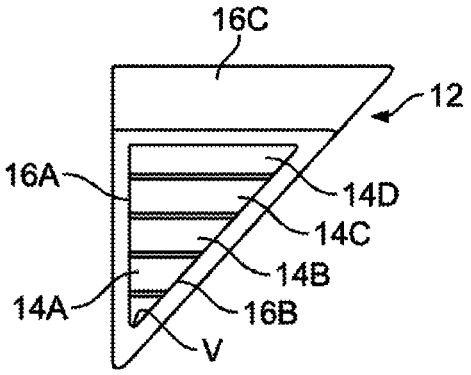
FIG. 6A is a plan view of the blade holding frame of FIG. 1
Figure 6B:
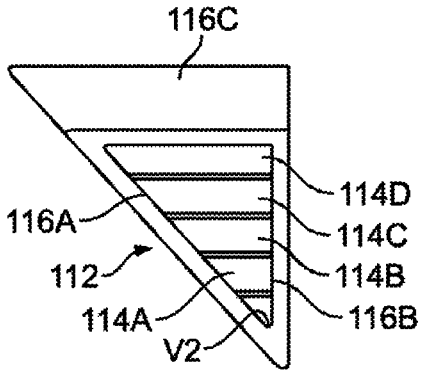
FIG. 6B is a plan view of an alternate blade holding frame having an outline that is a mirror image of that shown in FIG. 6A.

Referring FIG. 6B, another triangular shaver is shown with a right triangular outline (region) that is the mirror image of that shown in FIG. 6A (i.e., non-congruent). Components corresponding to those previously described bear the same reference numeral but increased by 100. The cutting edges of blades 114A-114D lie in a triangular region and have lengths and length ranges similar to those previously described. In addition, the distance between the cutting edges of blades 114A and 114D bears a ratio to the distance between the cutting edge of blade 114A and vertex V2 that is similar to that previously described.

Figure 6C:
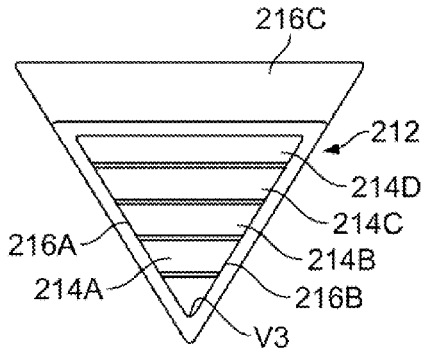
FIG. 6C is a plan view of an blade holding frame with an isosceles triangular outline that is an alternative to that shown in FIGS. 6A and 6B.

Referring FIG. 6C, a triangular shaver is shown with an isoceles triangular outline (i.e., a region non-congruent to that of FIG. 6A). Components corresponding to those previously described In FIGS. 1-4, and 6A bear the same reference numeral but increased by 200. The cutting edges of blades 214A-214D lie in a triangular region and have lengths and length ranges similar to those previously described. In addition the distance between the cutting edges of blades 214A and 214D bears a ratio to the distance between the cutting edge of blade 214A and vertex V3 that is similar to that previously described.

Figure 6D:
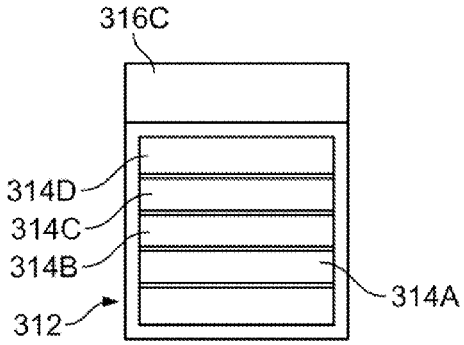
FIG. 6D is a plan view of an blade holding frame with a relatively narrow, rectangular outline that is an alternative to that shown in FIGS. 6A-6C.

Referring FIG. 6D, a rectangular shaver is shown with a rectangular outline (in fact, this outline is close to being square). Components corresponding to those previously described in FIGS. 1-4, and 6A bear the same reference numeral but increased by 300. Blades 314A-314D have equal lengths.

Figure 6E:
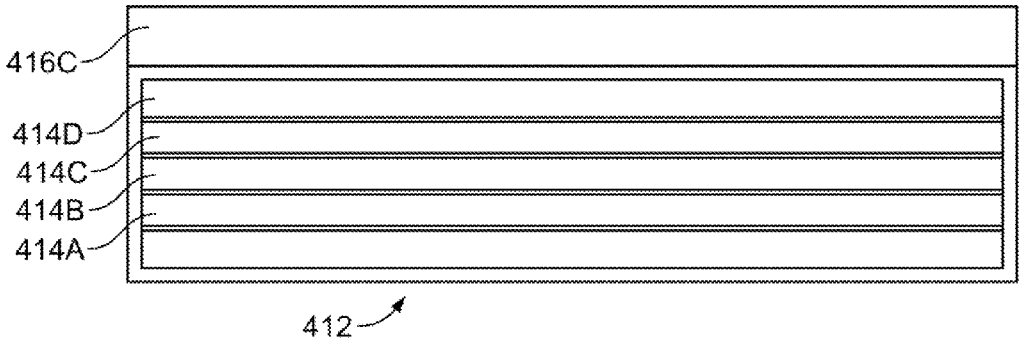
FIG. 6E is a plan view of an blade holding frame with a relatively wide, rectangular outline that is an alternative to that shown in FIGS. 6A-6D.

Referring FIG. 6E, an elongated, rectangular shaver is shown with a wide rectangular outline (much wider than the shaver shown in FIG. 6D). Components corresponding to those previously described in FIGS. 1-4, and 6A bear the same reference numeral but increased by 400. Blades 414A-414D have equal lengths.

In some cases the foregoing frames 12, 112, 212, 312 or 412 may be replacing a frame previously mounted on handle 40, in which case the new frame will be referred to as a replacement frame having a plurality of blades.

Figure 7:
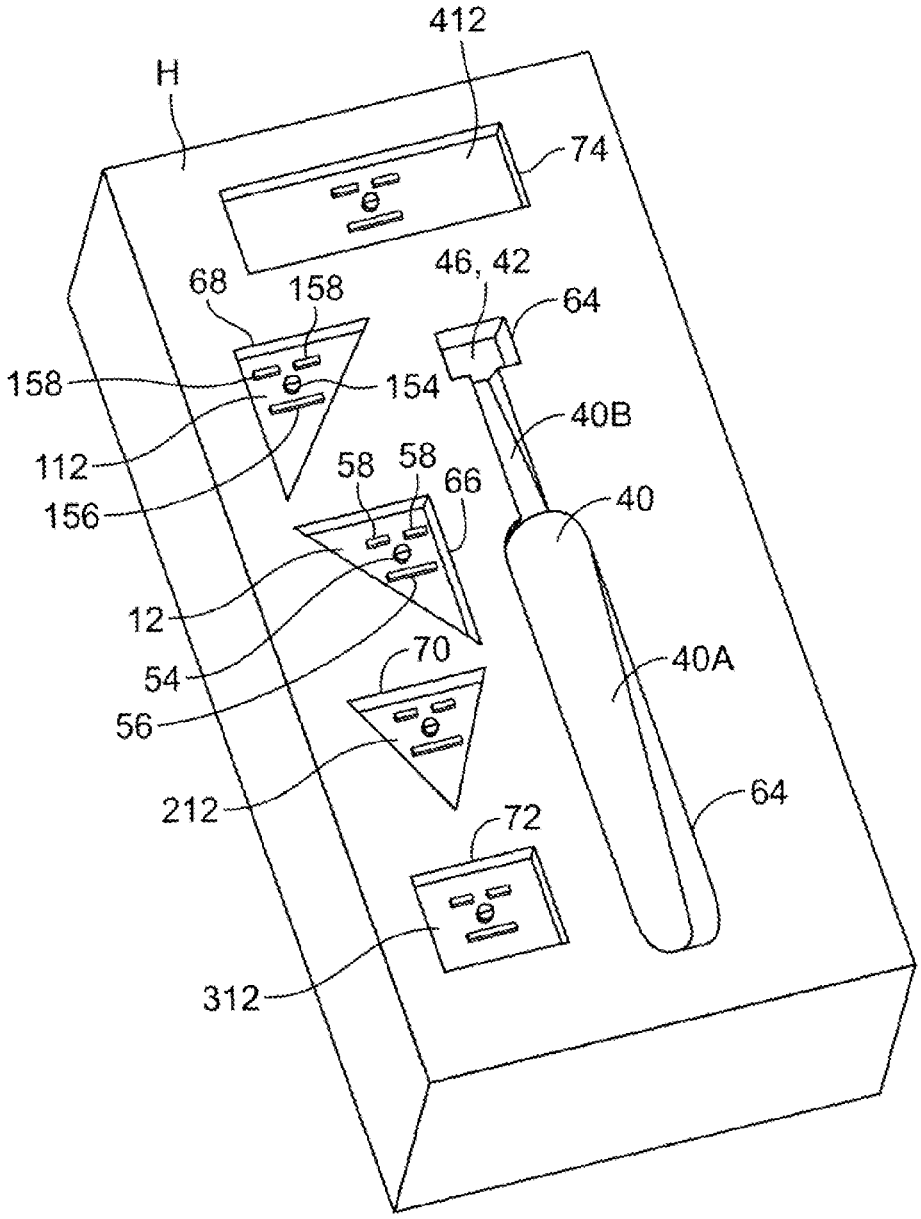
FIG. 7 is a perspective view of a holder for holding the handle of FIG. 1 (disassembled) as well as the blade holding frames of FIGS. 6A-6E.

Referring to FIG. 7, holder H is in the form of a blow molded shell with a number of recesses in its front side. Recess 64 is shown holding handle 40 as well as the pivoting head (previously mentioned block 42 and clevis 46). Recess 66 is shown holding previously mentioned frame 12. Previously mentioned prong 54 and walls 56, 58 are visible on frame 12 in this view. Recess 68 is shown holding previously mentioned frame 112, which is exhibiting a prong and walls identical to that of frame 12. Recess 70 is shown holding previously mentioned frame 212, which is also exhibiting a prong and walls identical to that of frame 12. Recess 72 and 74 are shown holding previously mentioned frames 312 and 412, respectively, which frames are each exhibiting a prong and walls identical to that of frame 12.

The foregoing recesses may be undercut or otherwise have a snug fit so that their associated frame will not be inadvertently dislodged from holder H.

Figure 8:
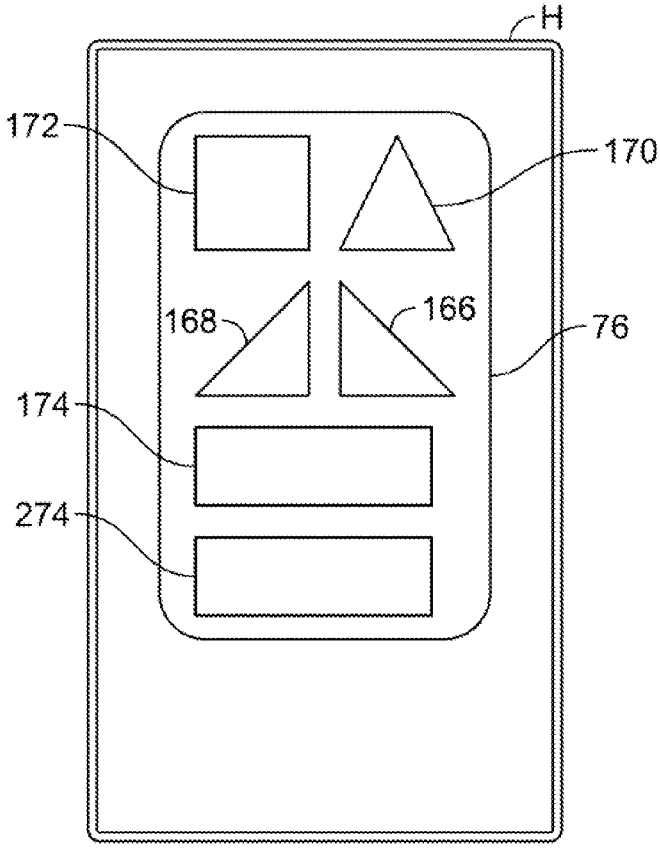
FIG. 8 is a plan view of the back of the holder of FIG. 7 showing additional recesses for holding more of the blade holding frames shown in FIG. 7.

Referring to FIG. 8, the rear side of holder H has another blow molded holder 76 with a number of recesses 166, 168, 170, 172, 174 and 274, which recesses are shown empty but are designed to hold additional shaving frames. Recesses having a profile corresponding to a those illustrated in FIG. 7 will have the same reference numeral but increased by 100.

To facilitate an understanding of the principles associated with the foregoing apparatus, the operation of the embodiment of FIGS. 1-4, and 6A will be briefly described, although it will be appreciated that the other embodiments will operate in a similar manner.

Figure 9:
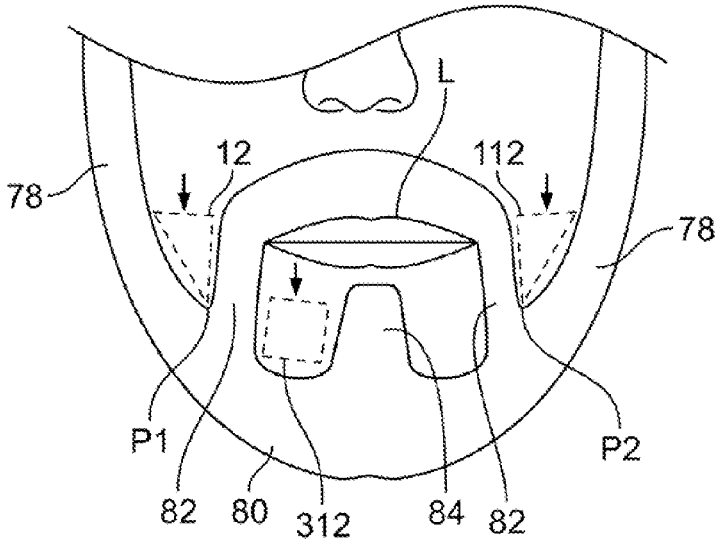
FIG. 9 is a diagram showing facial regions being shaved and sculpted around a beard, mustache, and other regions of hair growth.

Referring to FIG. 9, areas of hair growth are shown on the face of a user (or person to be shaved by a user). In this case facial hair has been trimmed to include a distinct mustache with a branch 82 that joins to a beard that covers jawbone regions 78 and chin region 80. The beard has also been trimmed to include a branch 84 that runs from chin region 80 to just below lips L.

The region to the outside of branches 82 and to the inside of jawbone regions 78 are approximately triangular facial sections that extend roughly from the height of lips L down to remote vertices P1 and P2, that is, extending below and to the outside of the lips. These two triangular facial sections may be areas of hair growth that require periodic shaving or sculpting.

The right one of these triangular facial regions is shown being shaved and sculpted by previously mentioned shaver frame 12 (frame 12 is shown in phantom in FIG. 9). As indicated by the adjacent arrow, frame 12 is being moved downwardly toward remote vertex P1.

Each of the cutting edges 14A1-14D1 are close to plane 32 (FIG. 2) so that the cutting edges can bear against the facial skin and hair to be shaved. Cutting edges 14A1-14D1 are kept at a cutting angle a, relative to the facial skin. Also, cutting edges 14A1-14D1 are kept within the triangular region between sections 78 and 82 in such a manner as to maintain a triangular shape, unless the user desires change the size or shape of the triangular region.

As it moves across the facial region, shaver frame 12 is able to pivot on pin 50 (FIG. 2). This pivoting motion will accommodate the changing contour of the face as well as any changing orientation of handle 40. Arms 42B tend to bias the angle elevation of frame 12 clockwise (as shown in FIG. 2).

Triangular shaver 12 is oriented so that its vertex V (FIG. 1) is pointing towards remote vertex P1 (FIG. 9). Thus the shortest one of the cutting edges 14A1 is in the leading position while the longest cutting edge 14D1 is in the trailing position. Consequently, cutting edge 14A1 can get very close to remote vertex P1. In fact, the ultimate separation between vertex P1 and edge 14A1 will, in this embodiment, be less than one third the distance between the shortest cutting edge 14A1 and the longest cutting edge 14A1. However, satisfactory results can be achieved if the separation between vertex P1 and edge 14A1 is simply less than the distance between edges 14A1 and 14D1.

Next, the user may wish to shave in the triangular region on the left between sections 78 and 82. As indicated in FIG. 9, this region is best accessed by shaver frame 112. Accordingly, the user will push ridge 56B upwardly so that arm 56C of slider 56 will bear against prong 54. Consequently, prong 54 will compress and be driven through hole 52 on clevis 46. The releasing of frame 12 can be performed after the frame has been pressed into an appropriate, available recess, either recess 66 of holder H (FIG. 7) or recess 166 of holder 76 (FIG. 8).

Thereafter, handle 40 will be used to press hole 52 of clevis 46 onto prong 154 of frame 112 located in recess 68 of holder H. Clevis 46 will be oriented so that its key 60 is inserted in the gap in walls 158. (Components in recess 68 corresponding to those in recess 66 have the same reference numeral but increased by 100.) As described previously, prong 154 will compress until its beaded rim passes through hole 52 and snaps into place. Thereafter, handle 40 can be used to pull frame 112 from recess 68.

With tapered frame 112 mounted on handle 40 a user can now apply the frame as shown in FIG. 9 between sections 78 and 82 on the left. As before, the longest blade 114D is in the trailing position, while shortest blade 114A is placed in the lead position and moved close to remote vertex P2. Also as before, the ultimate separation between vertex P2 and blade 114A will be less than one third the distance between blades 114A and 114D (but, in some cases, merely less than the distance between blades 114A and 114D).

Next thumb slide 56B will be used to press arm 56C against prong 154 to dislodge frame 112 in the manner previously described. Frame 112 can then be returned to recess 68. Handle 40 can then be used to press hole 52 of clevis 46 onto the underside of shaving frame 312, which has a prong and walls identical to those shown for frame 12. Accordingly, frame 312 will snap onto clevis 46

The area between the branches 82 and between lips L and chin region 80 are divided into two roughly rectangular regions by branch 84. Accordingly, frame 312 will be very effective in shaving these regions and is shown shaving the right one of these regions in FIG. 9.

While the foregoing selected and used frames 12, 112 and 312, in some cases the area to the shaved would be better served by the isosceles triangular shape of frame 212. For broad facial regions, shaving frame 412 can be mounted on clevis 46 and used in the conventional manner.

It is appreciated that various modifications may be implemented with respect to the above described embodiments. In some embodiments, the shaving frame will be biased to rotate in the opposite direction. Also, the biasing can be performed by separate springs (coil or leaf springs) or by a compressible member such as a foam or elastomeric material. In other embodiments, the shaving frame will not pivot but will be held at a fixed angle. While four blades are shown in a single frame, other embodiments may have a fewer or greater number of blades. The triangular frames can employ any variety of triangles and combination of angles. While the blades and pivot pin are typically steel, and the other materials are typically plastic, in other embodiments different materials may be used, as well as different shapes and sizes. Also, the foregoing shavers can be used on areas of hair growth other than those shown. While triangular and rectangular outlines are shown, in some embodiments other polygonal shapes may be used or the outline may have one or more curved sides. Instead of the illustrated snap joint, the frame may be released/secured by other means, such as threads, bayonet joints, tongue and groove joints, etc. Instead of releasable frames, some embodiments may have frames that are non-releaseable. Instead of shelves, the blades may be secured in slots, with or without spacers.

Obviously, many modifications and variations of the present invention are possible in light of the above teachings. It is therefore to be understood that within the scope of the appended claims, the invention may be practiced otherwise than as specifically described.

The invention claimed is:

1. A method for shaving and sculpting an area of hair growth on a person, the method employing a tapered shaver with a spaced plurality of progressively shorter cutting edges, the method comprising the steps of:

moving the tapered shaver across the area of hair growth with the shortest one of the cutting edges in a leading position, while keeping the cutting edges substantially within a triangular facial section having a remote vertex, in order to remove hair from inside the triangular facial section; and interrupting shaving movement of the shaver when the shortest one of the cutting edges (a) arrives close to the remote vertex without bringing the cutting edges substantially outside the triangular facial section, and (b) is spaced from the remote vertex by a distance that is less than the spacing between the longest one and the shortest one of the cutting edges.

2. A method according to claim 1 wherein the step moving the tapered shaver is performed by moving the shaver toward the remote vertex.

3. A method according to claim 1 wherein the triangular section extends below and to the outside of the person's lips.

4. A method according to claim 1 employing a rectangular shaver with a spaced plurality of equally long cutting edges, the method comprising the step of:

moving the rectangular shaver across the area of hair growth.

5. A method according to claim 4 employing an elongated shaver with a spaced plurality of equally long cutting edges, the method comprising the step of:

moving the elongated shaver across the area of hair growth to shave per stroke a wider region than that shaved by the rectangular shaver.

6. A method according to claim 4 employing a holder with a plurality of recesses, the method comprising the step of:

storing the tapered shaver, the rectangular shaver and the elongated shaver in corresponding ones of the recesses in the holder.

7. A method according to claim 6 employing a handle, comprising the step of:

snapping the handle onto the tapered shaver while it is stored in the holder.

8. A method according to claim 1 wherein the step of interrupting shaving movement is performed when the shortest one of the cutting edges is spaced from the remote vertex by a distance that is less than one third the spacing between the longest one and the shortest one of the cutting edges.

9. A razor for shaving and sculpting an area of hair growth on a person, comprising:

a handle;

a tapered frame supported by said handle; and a spaced plurality of blades mounted on said tapered frame and having progressively shorter cutting edges, said cutting edges all lying along a single working surface for simultaneously engaging the area of hair growth, said cutting edges having ends lying along a converging pair of sides of a triangular surface, whose third side is collinear with the longest one of said cutting edges, said working surface and said triangular surface facing in substantially the same direction, the shortest one of said cutting edges being closest to a distal vertex formed by said converging pair of sides, the spacing between the longest and the shortest one of said cutting edges exceeding the distance from the shortest one to the distal vertex.

10. A razor according to claim 9 wherein said triangular surface is a right triangular surface.

11. A razor according to claim 9 wherein said triangular surface is an isoceles triangular surface.

12. A razor according to claim 9 wherein the longest one of the cutting edges is more than twice as long as the shortest one.

13. A razor according to claim 9 wherein the longest one of the cutting edges is more than four times as long as the shortest one.

14. A razor according to claim 9 wherein the spacing between the longest and the shortest one of said cutting edges exceeds three times the distance from the shortest one to the distal vertex.

15. A razor according to claim 9 wherein said tapered frame is releasably attached to said handle.

16. A razor according to claim 15 comprising:

one or more substitute frames, each adapted to releasably attach to said handle, said razor comprising for each of said substitute frames:

a spaced plurality of blades.

17. A razor according to claim 16 wherein said one of more substitute frames include at least one with a rectangular outline.

18. A razor according to claim 16 wherein said substitute frames include at least two with rectangular outlines of differing width.

19. A razor according to claim 16 wherein said substitute frames include (a) at least one with a triangular outline that is non-congruent to said triangular surface, and (b) at least two with rectangular outlines of differing width.

20. A razor according to claim 17 wherein said handle includes a joint for rotatably supporting said tapered frame.

21. A razor according to claim 20 wherein said joint is biased to change the angle of elevation of said tapered frame.

22. A razor according to claim 17 comprising:

a holder having a plurality of recesses for holding said handle, said tapered frame, and said one or more substitute frames.

23. A razor according to claim 22 wherein said holder has a front and a rear side, said plurality of recesses being distributed on the front and the rear side.

24. A razor according to claim 9 wherein said tapered frame has a plurality of tiers, different ones of said plurality of blades being mounted on different ones of said tiers.

25. A razor according to claim 24 wherein each of said tiers has at least one stub for securing at least one of said plurality of blades.

26. A razor according to claim 24 comprising:

a plurality of spacers, each of said plurality of spacers being mounted to an associated one of said plurality of tiers between a corresponding pair of said plurality of blades that have differing transverse dimensions.

27. A razor according to claim 24 comprising:

a plurality of spacers, each of said plurality of spacers being mounted between a corresponding pair of said plurality of blades to an associated one of said plurality of tiers.

28. A razor according to claim 27 wherein each of said tiers has at least one stub for securing one of said plurality of spacers together with its corresponding pair of said plurality of blades.

* * * * *